United States Patent [19]

Taylor

[11] 4,397,255

[45] Aug. 9, 1983

[54] ANCHOR HOLDING CAPACITY AUGMENTATION SYSTEM

[75] Inventor: Robert J. Taylor, Camarillo, Calif.

[73] Assignee: The United States of America as represented by the Secretary of the Navy, Washington, D.C.

[21] Appl. No.: 273,825

[22] Filed: Jun. 15, 1981

[51] Int. Cl.[3] ..... B63B 21/24

[52] U.S. Cl. ..... 114/294

[58] Field of Search ..... 114/293-310; 52/155-165; D12/215

[56] References Cited

U.S. PATENT DOCUMENTS 3,685,479 8/1972 Bruce ..... 114/294

4,290,245 9/1981 Pardue et al. ..... 52/165

FOREIGN PATENT DOCUMENTS 1565613 5/1969 France ..... 114/294

212088 2/1968 U.S.S.R. ..... 114/294

*Primary Examiner*—Trygve M. Blix

*Assistant Examiner*—Jesús D. Sotelo

*Attorney, Agent, or Firm*—Robert F. Beers; Joseph M. St.Amand

[57] ABSTRACT

A series of spaced in-line plates attached to a through wire, rope or chain mooring line is placed between an anchor and the main mooring line to enhance overall mooring capability of an installed anchor of any of a variety of types including stake piles, propellant embedment anchors, vibratory anchors, and jetted in anchors. For the device to be functional the mooring lead should be approximately unidirectional and mooring scope should be such that upon loading, the anchor plate system is forced into the seafloor as the line catenary between the anchor deadman and the moored object straightens.

11 Claims, 9 Drawing Figures

ANCHOR HOLDING CAPACITY AUGMENTATION SYSTEM

BACKGROUND OF THE INVENTION

This invention relates to anchors and more particularly to a system for augmenting the holding capacity of installed deadman type anchors including stakepiles, propellant-embedded anchors, vibrated-in anchors, jetted-in anchors and clumps.

There are frequent problems in anchoring in soft seafloors. Prior techniques to increase anchorage capacity involve using larger single anchors, or using multiple anchors. These prior techniques can greatly complicate anchor installation and are often limited in application due to the availability of equipment to install larger anchors. Attempts to use conventional drag anchors in conjunction with stake piles to increase mooring capacity have been ineffective because the different anchor types have different load deformation characteristics and it is difficult or impractical to ensure that both anchors work together.

The present invention greatly increases the unidirectional holding capacity of pre-installed deadman-type anchors, and reduces load handling requirements while increasing anchor system capacity. In addition, the invention expands the utility of existing deadman-type anchors and can provide a capability where none presently exists, such as providing single anchor leg anchoring capability beyond the normal limits of an anchor. The invention increases anchor holding capacity without increasing installation complexity or the requirement for greater embedment energy. This anchor holding capacity augmentation system is especially suited for use in soft sediments where anchoring ability of conventional anchors is limited.

SUMMARY OF THE INVENTION

The anchor holding capacity augmentation system consists of a series of spaced in-line plates attached to a through wire rope or chain mooring line. The series of plates is placed between an installed anchor and the main mooring line to enhance overall mooring capability. The anchor can be any of a variety of types including stake piles, propellant embedment anchors, vibratory anchors, jetted-in anchors, or conventional dead weight anchors. For the device to be functional, the mooring load should be approximately unidirectional and the mooring scope should be such that upon loading, the system of anchor plates is forced into the seafloor as the line catenary between the anchor deadman and moored object straightens. The spaced in line plates can be fabricated from iron or steel, plastic, etc., and can be attached to the through cable by a variety of attachment means, such as clamps, Kjellam grips, grapevine stoppers, wedge stoppers, etc. The plates can be constructed in various shapes; however, circular or square plates are the easiest and least expensive to construct. The attachment means must be such that the plates remain substantially normal to the line of action of the mooring line. The anchor augmentation system in itself is a plate anchoring system comprised of a series of spaced in-line plates attached to a through wire, rope, or chain. The plate anchoring system can be used to augment the holding capacity of embedded type anchors, and is used between an embedded anchor and the mooring line to a moored object.

DESCRIPTION OF THE PREFERRED EMBODIMENTS

Figure 1:
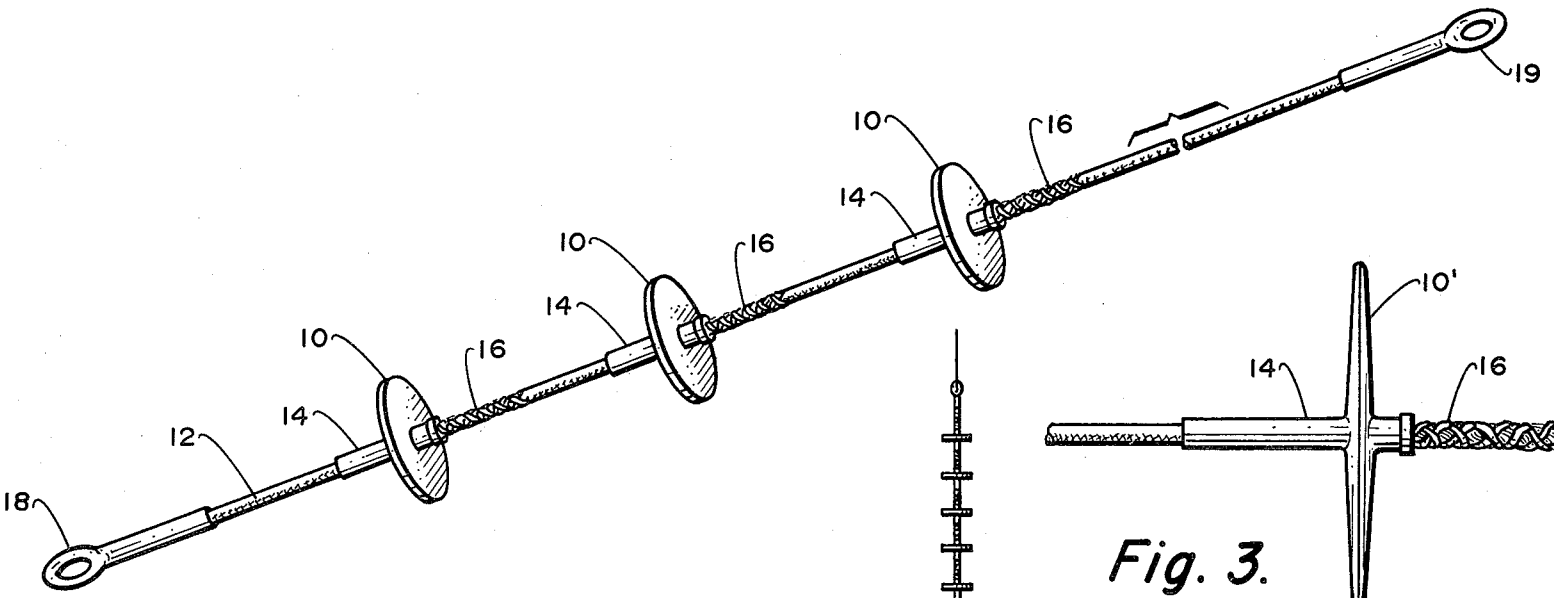
FIG. 1 shows a foreshortened section of a preferred embodiment of a plate anchoring device used in the anchor holding capacity augmentation system.

The anchor holding capacity augmentation system consists of a plurality of plates 10 attached to a line 12, such as shown in FIG. 1, and separated from each other by a distance selected to ensure maximum holding capacity with a minimum number of plates. The distance between plates is a function of seafloor soil type, but for soft seafloors, spacing of approximately two plate diameters has proven to be suitable.

Figure 2:
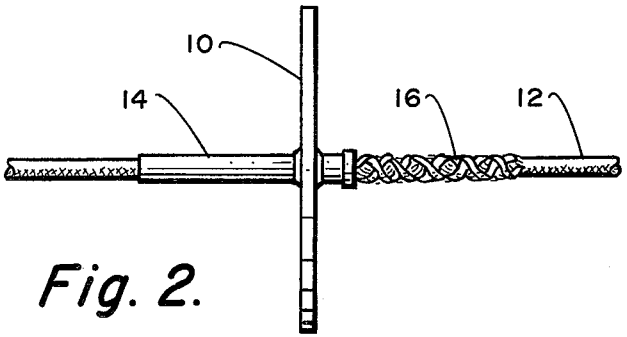
FIG. 2 is a side view of a single plate section of the system shown in FIG. 1.
Figure 3:
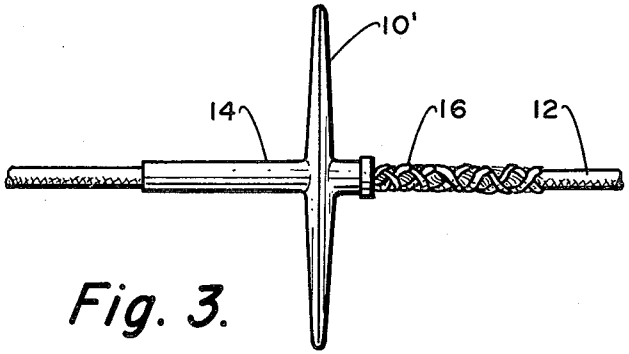
FIG. 3 shows a side view of a different embodiment of a single plate section.

Plates 10 are typically circular, as shown, or square, but are not limited to these shapes. However, symmetrical shapes are considered superior. Line 12 can be made from wire rope, synthetic or other high tensile material, or chain. As shown more clearly in FIG. 2, plates 10, have a tubular or pipe section 14 affixed perpendicular to the plane of the plate by welding, for example. Tubular section 14 extends mostly from one side of plate 10 and is of sufficient length to maintain plate 10 substantially normal to the line of action of line 12. A cable grip 16, such as a Kjellam grip, as shown in FIGS. 1, 2 and 3, is used to lock or attach plate 10 in position along line 12. Other suitable types of grips or clamps can be used, as desired. The plates are constructed of iron, steel, plastic or any other high strength material capable of being formed in thin sections. The plates can be tapered in thickness from the center to the edge as plate 10' shown in FIG. 3. If desired, plates 10 or 10' can be molded together with tubular section 14 from cast iron, steel, high strength plastics, etc., as shown in FIG. 3.

The ends of line 12 can be provided with eyes 18 and 19, respectively, for convenience in connecting to segments of the mooring line connected to an anchor, as will be hereinafter discussed.

The augmentation system described herein is usually connected after an anchor is installed, and is connected to the end of the anchor pendant or initial portion of mooring line between the embedded anchor and the seafloor. The length of the anchor pendant is usually predicated on the anticipated depth of the embedded anchor into the seafloor soil. The bitter end of the anchor pendant or initial portion of mooring line should not be below the surface of the seafloor so as to pull the plates of the augmentation system vertically into the seafloor.

Figure 4:
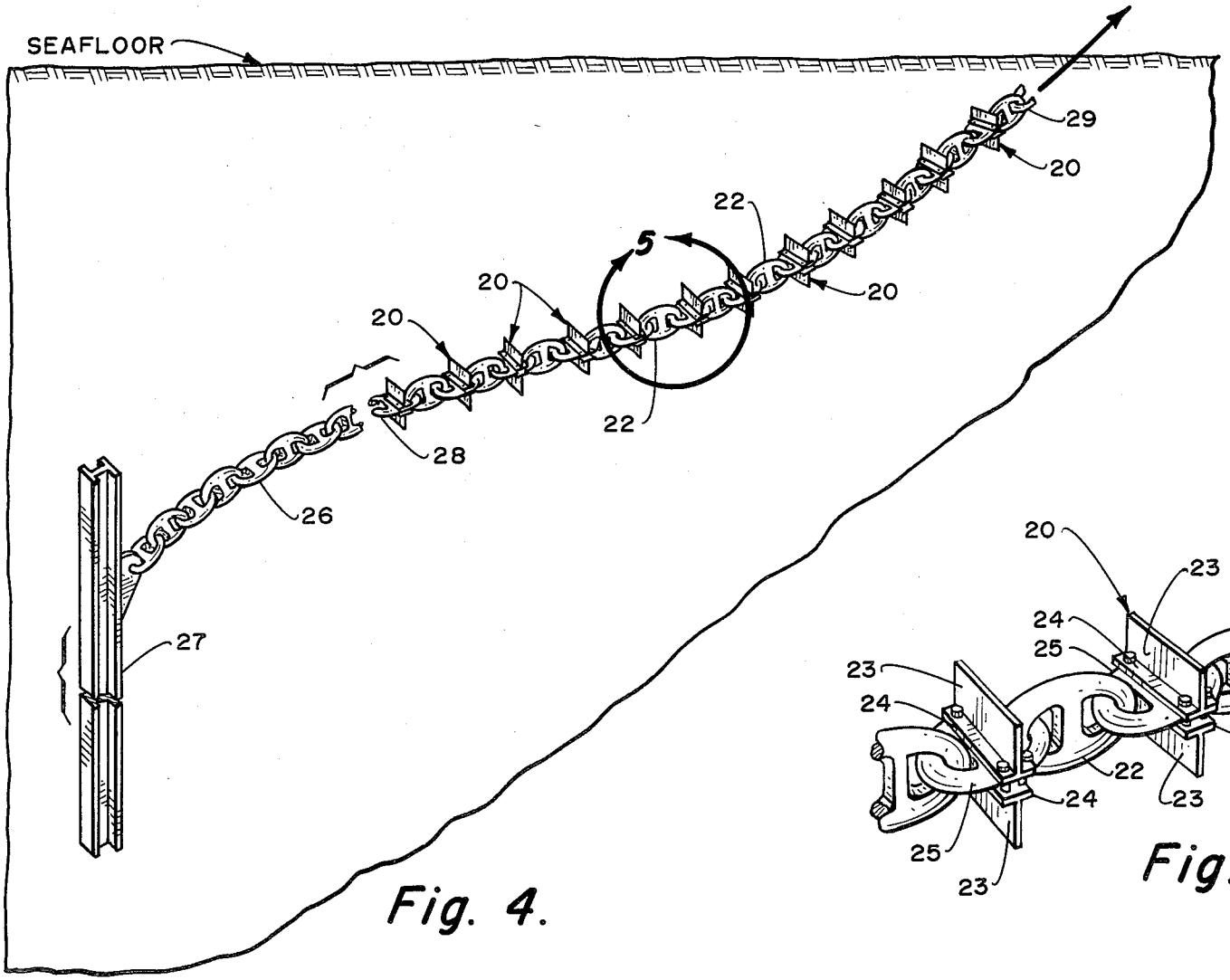
FIG. 4 shows an embodiment of the invention with plates attached to anchor chain.
Figure 5:
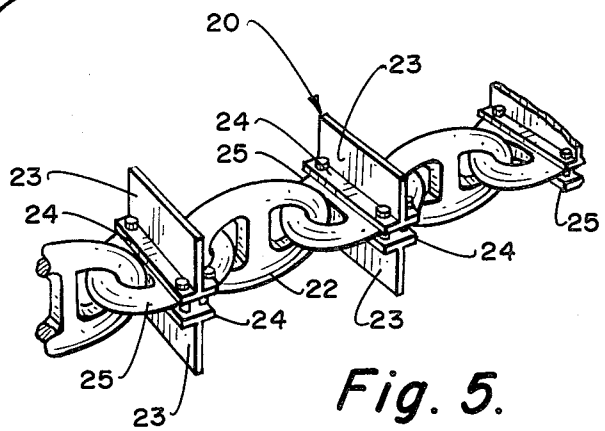
FIG. 5 is an enlarged view of a section of the plate anchoring device of the system shown in FIG. 4.

As shown in FIG. 4, another embodiment of the invention has plates 20 attached to anchor chain 22 by clamping the plates to individual chain links as shown in detail in FIG. 5. A pair of plate sections 23 provided with flanges 24 are bolted about a chain link 25 to form a plate whose plane is perpendicular to the chain line, as shown. An initial length of chain 26 is provided between the stake pile anchor 27 and the lower end 28 of the augmentation system. The upper end 29 of the system is connected to a mooring line to the moored object, not shown.

The overall length of the augmentation system can vary from a few feet to sev ral hundred feet depending upon the soil type, deadman anchor capacity, mooring line scope, and mooring load.

Figure 8:
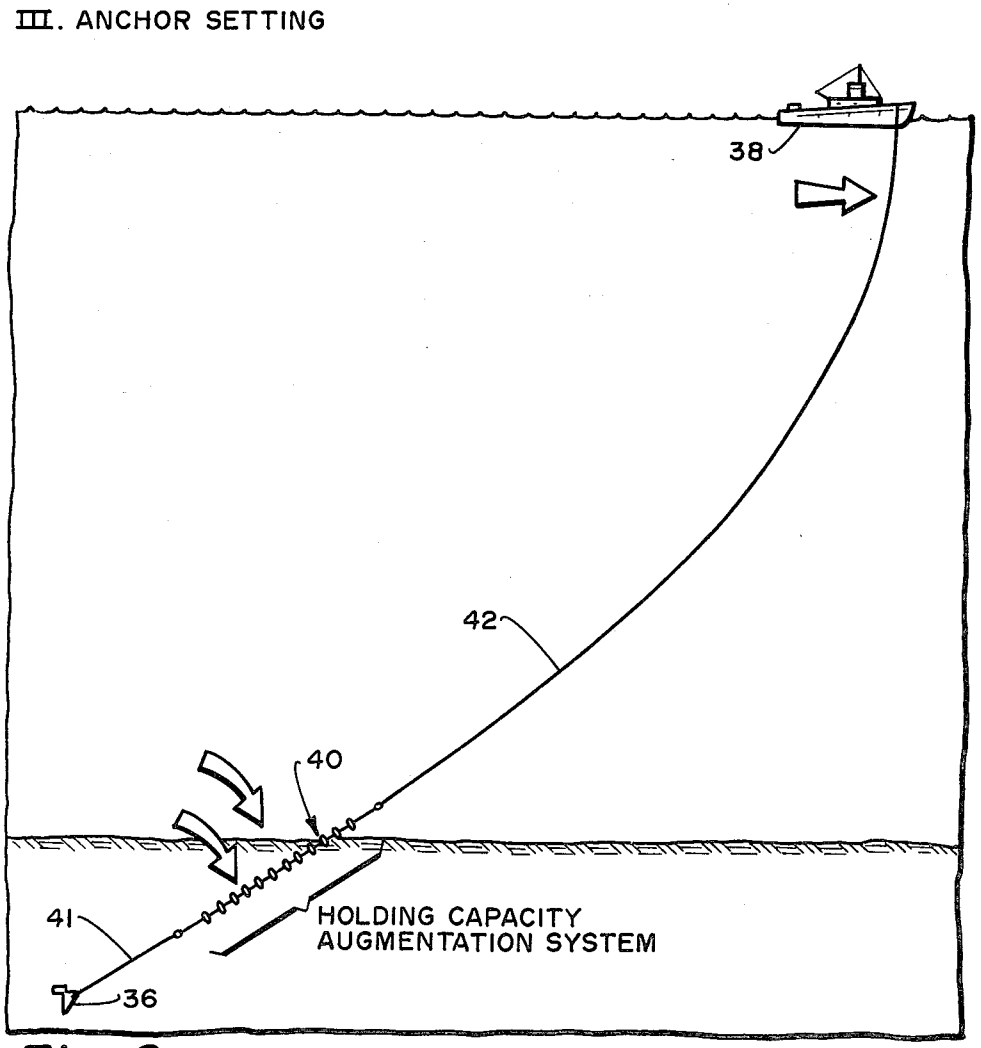
FIGS. 6, 7 and 8 show an anchor system installation scenario using the holding capacity augmentation system of this invention.
Figure 7:
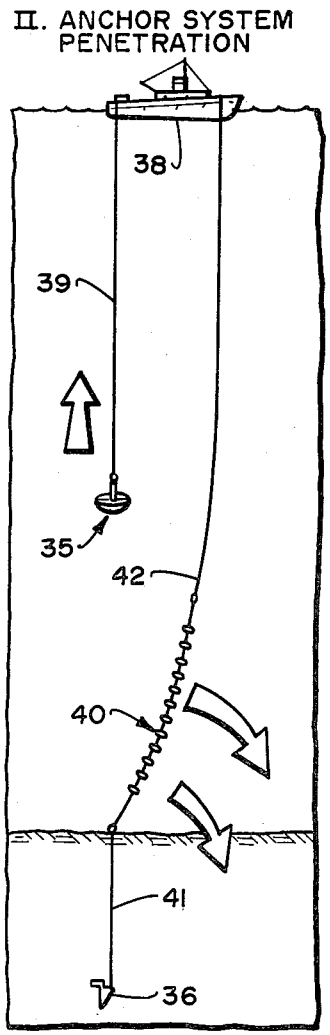
Figure 6:
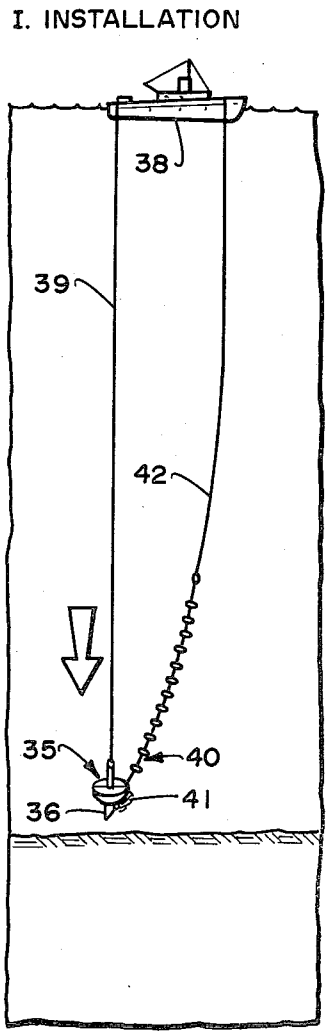

A typical anchor system installation scenario, using a propellant embedment anchor, of the type such as disclosed in copending U.S. patent application Ser. No. 258,122 filed Apr. 27, 1981, together with an anchor holding capacity augmentation system of this invention, is shown in FIGS. 6, 7 and 8. In FIG. 6 an embedment anchor system 35 which includes an anchor 36 is lowered from ship 38 to the seafloor with lowering/retrieval line 39. The lower end of the augmentation system 40 is connected to the downhaul cable 41 of anchor 36, which is faked (i.e., zig-zag coiled) on the side of embedment anchor system 35. The upper end of augmentation system 40 is connected to the main mooring line 42 connected to ship 38. After the anchor 36 is embedded into the seafloor, as shown in FIG. 7, and the embedment system 35 is retrieved with line 39, ship 38 moves forward causing the plates of the augmentation system 40 to move in the direction of the arrows and penetrate the seafloor soil. As shown in the drawings the plates 10 and 10' are always maintained substantially perpendicular to the cable 12 of augmentation system 40. As ship 38 continues to move ahead and the augmentation system plates are forced edgewise into the seafloor, the line catenary (formed by the down-haul cable 41, the line of the holding capacity augmentation system 40 and main mooring line 42) between anchor 36 and ship 38 straightens as shown in FIG. 8. When the line is straightened out and the plates embedded in the seafloor, the plates of augmentation system 40 provide additional holding capacity.

As previously mentioned, any type anchor can be used, and an embedment system 35, as shown in FIG. 6, is merely shown by way of example. The anchor (or initial anchoring means where the present invention is being used as the main anchoring system) is first embedded vertically into the seafloor to a desired depth below the surface. The anchor pendant or initial segment of mooring line (such as cable 41) should be of such length that its upper end is near the seafloor surface and does not operate to pull the augmentation system 40 vertically into the seafloor. The augmentation system can be preconnected to the anchor cable or could be post attached by divers at shallow water sites. With the upper end at or above the seafloor surface divers can readily make connection to the end of cable 41 to increase the anchors holding capacity. The augmentation system 40 and initial segment of mooring line 41 are in a generally vertical position when first connected in preparing to set the anchor augmentation system; the augmentation system then penetrates the seafloor with plates 10 moving in an edgewise direction as mooring line 42 swings sideways (such as shown in FIG. 8) to complete the setting of the augmentation system.

Figure 9:
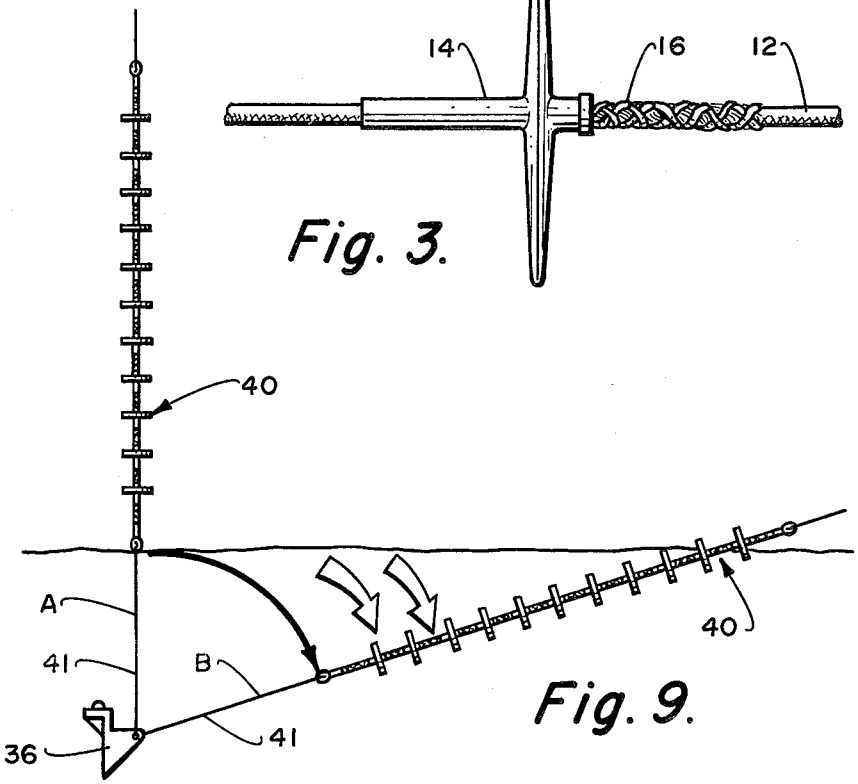
FIG. 9 is a diagram illustrating the setting of the plate anchoring device of this invention.

An example of an anchoring system for a 20K anchor installed in a typical offshore deposit of normally consolidated silty clay using the present type load augmentation system is given below. A down-haul cable of 45 to 50 foot length is used and a 60 foot load augmentation system is attached to the upper end of the down-haul cable, as shown in position A of FIG. 9. A 20K anchor holds approximately 40,000 pounds in a normally consolidated silty clay with penetration into the seafloor of about 40 feet. Once the mooring line is made taut, and the augmentation system is pulled into the seafloor, as shown in position B of FIG. 9, the upper end of the down-haul cable will be about 20 to 25 feet deep in the seafloor. If 9-inch square plates spaced at 18-inch intervals along the 60 feet of augmentation system line are used (i.e., 40 plates), the augmentation system will also hold about 40,000 pounds. This is a conservative amount assuming an average 1 psi shear strength over the 60 foot length of the augmentation system cable. The augmentation system cable can be longer than 60 feet, and the plates larger than 9 inches square. However, even the small system given in the above example doubles the capacity of the embedment anchor system. The required plate thickness for this example is small. At 1000 pounds per plate, the required thickness for a 9-inch diameter plate is only 0.035 inch. A detailed analysis should be made to determine the maximum plate sizes allowable as a function of soil strength at the anchoring site and the deadman capacity.

The foregoing anchor system is superior to the use of chain as normally used for the portion of the mooring line leg eventually submersed in the seafloor soil, even for stake piles. Penetration of a cable/plate system is significantly easier than chain alone given the same cable tension.

In some soils (e.g., muds, soft clays, and calcareous types) it is often difficult to get large holding capacities from stake piles, either because of limited pile driver capabilities or load handling capabilities. Also, chain is known to reduce loads at a stake pile. A cable/plate load augmentation system as herein disclosed is significantly superior to chain given comparable line tensions and penetration resistances.

Obviously, many modifications and variations of the present invention are posible in the light of the above teachings. It is therefore to be understood that within the scope of the appended claims the invention may be practiced otherwise than as specifically described.

What is claimed is:

1. An anchor holding capacity augmentation system for enhancing the overall mooring capability of an embedded anchor in soft seafloors, comprising:

a. a mooring line connected between the anchor and an object to be moored;

b. a segment of said mooring line comprising a chain;

c. a plurality of spaced in-line plate means attached along said chain segment of said mooring line for a predetermined distance from a point on said mooring line segment above the seafloor toward the object to be moored when said mooring line is in a substantially vertical position above the anchor;

d. means for securely fastening each said plate means onto individual chain links of said segment of mooring line;

e. said plate means each having a determined planar area for providing a given amount of holding capacity under unidirectional mooring loads along said mooring line when embedded into the seafloor;

f. means associated with each said plate means for maintaining the plate means in a position such that the planar area thereof is maintained substantially normal to the line of action of said mooring line;

g. each said plate means penetrating and being embedded edgewise into the seafloor as said mooring line swings from said substantially vertical position to an inclined position with the seafloor as a mooring load is applied.

2. A system as in claim 1 wherein said mooring line passes through each said plate means.

3. A system as in claim 1 wherein each said plate means is symmetrical.

4. A system as in claim 1 wherein said mooring line passes through each said plate means substantially at the center of the planar area thereof.

5. A system as in claim 1 wherein the dimensions of each said plate means is determined from seafloor soil strength and mooring load.

6. A system as in claim 1 wherein the spacing distance between each said plate means is a function of seafloor soil type.

7. A system as in claim 1 wherein spacing between each said plate means is approximately twice the width of a plate means.

8. A system as in claim 1 wherein each said plate means comprises a flat plate of high tensile strength material.

9. A system as in claim 1 wherein each said plate means comprises high tensile strength material which tapers from the center thereof to a thin edge.

10. A system as in claim 1 wherein said plate means are spaced apart a distance determined to ensure maximum holding capacity with a minimum number of plate means.

11. A system as in claim 1 wherein each said plate means and respective said means for maintaining the plate means normal to said mooring line are each formed in one unitary body.

* * * * *